US008714412B2

(12) United States Patent
Benigni et al.

(10) Patent No.: US 8,714,412 B2
(45) Date of Patent: May 6, 2014

(54) FLUID DISPENSER HAVING A RETRACTABLE HEAD

(75) Inventors: Christophe Benigni, Pantin (FR); Vincent Druesne, Nanteuil sur Marne (FR)

(73) Assignee: Qualipac, Neuilly sur Seine (FR)

( * ) Notice: Subject to any disclaimer, the term of this patent is extended or adjusted under 35 U.S.C. 154(b) by 0 days.

(21) Appl. No.: 13/642,662

(22) PCT Filed: Apr. 14, 2011

(86) PCT No.: PCT/FR2011/000222

§ 371 (c)(1),
(2), (4) Date: Feb. 21, 2013

(87) PCT Pub. No.: WO2011/131855

PCT Pub. Date: Oct. 27, 2011

(65) Prior Publication Data

US 2013/0140330 A1 Jun. 6, 2013

(30) Foreign Application Priority Data

Apr. 22, 2010 (FR) ..... 10 53057

(51) Int. Cl.
*B67D 1/00* (2006.01)

(52) U.S. Cl.
USPC ..... 222/153.13; 222/153.11; 222/182

(58) Field of Classification Search
USPC ..... 222/153.11, 153.13, 182, 167, 321.1, 222/321.7, 321.9, 383.1, 383.3, 499; 206/446; 401/116
See application file for complete search history.

(56) References Cited

U.S. PATENT DOCUMENTS

| | | | | |
|---|---|---|---|---|
| 3,934,598 | A | 1/1976 | Hayes et al. | |
| 4,962,868 | A * | 10/1990 | Borchard | 222/49 |
| 5,499,747 | A * | 3/1996 | Quennessen | 222/167 |
| 8,308,029 | B2 * | 11/2012 | Ki | 222/309 |
| 8,439,230 | B2 * | 5/2013 | Hagen | 222/153.13 |
| 8,550,306 | B2 * | 10/2013 | Angus et al. | 222/153.11 |
| 2012/0292344 | A1 * | 11/2012 | Bertin et al. | 222/153.13 |
| 2013/0200107 | A1 * | 8/2013 | Presche | 222/153.13 |

FOREIGN PATENT DOCUMENTS

| | | | |
|---|---|---|---|
| FR | 2 489 116 | A1 | 3/1982 |
| FR | 2 708 437 | A1 | 2/1995 |
| WO | 2008/079801 | A2 | 7/2008 |

OTHER PUBLICATIONS

International Search Report, dated Jul. 1, 2011, from corresponding PCT application.

* cited by examiner

*Primary Examiner* — Kevin P Shaver
*Assistant Examiner* — Robert Nichols, II
(74) *Attorney, Agent, or Firm* — Young & Thompson

(57) ABSTRACT

A fluid product dispenser includes: a tubular body extending along a main axis; a male element, able to slide inside the tubular body; a volume for receiving the product, located inside the male element; a plate molding an external side surface of the tubular body, the plate being provided with at least one projection able to slide in a slit in the tubular body, substantially parallel to the main axis, the projection being able to move the male element in the tubular body, the dispenser including an element for locking the plate on the tubular body in at least two locking positions along the main axis. Thus, a dispensing head, firmly fixed to the male element, can be extracted or retracted by making the plate slide along the tubular body.

17 Claims, 3 Drawing Sheets

FLUID DISPENSER HAVING A RETRACTABLE HEAD

Figure 1A:
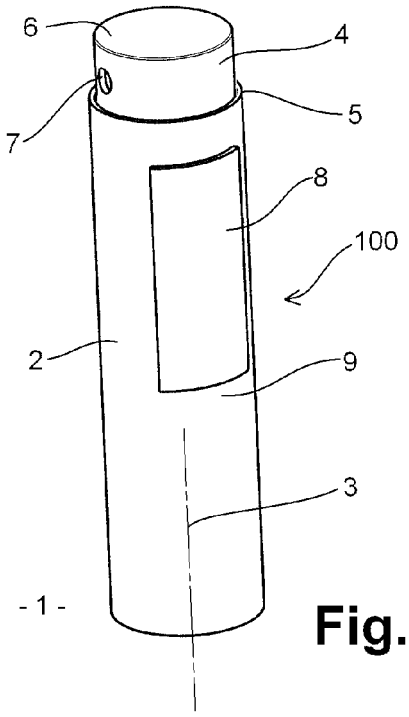

The invention refers to a fluid product dispenser, in particular for a cosmetic, hygienic or pharmaceutical product.

More precisely, the invention refers to a fluid product dispenser including an application element which can slide in a tubular body and be locked in at least two positions with respect to said tubular body.

The invention can be applied in particular in mobile dispensers, i.e. such a dispenser a user can take with her/him.

Mobile dispensers are in general carried in handbags so that they are in contact with the inside of said bag or with various objects. It is then necessary to protect the product dispensing member in order to prevent it from being dirtied or to prevent the product from being spread inside the bag. In a traditional way, the dispensing member is protected by a cap. However, the presence of such a cap complicates the dispenser handling.

Another way of protecting the dispensing member consists in providing a dispenser with a retractable head. The head supports the dispensing element. It can take a storage position inside a tubular body and a dispensing position projecting from said tubular body.

There exists in particular on the market a perfume spray whose head can be modified in position by rotating an element in a tubular body, according to a principle similar to that of a lipstick.

Such a device protects the dispensing member efficiently. However, the movement for releasing or storing the head forces the user to use her/his two hands.

Within the framework of the mobile dispensers, it is however advantageous to propose a device that can be actuated with only one hand. For example, Patent EP1718186 describes a dispenser comprising a tubular case in which a variable element slides, said element being ejected from the case by a spring when a user presses on a head of said element.

This solution is described in particular in the case of a lipstick. Although it is also applicable to the case of a fluid product dispenser, there are some constraints for making it, in particular regarding the actuation of the dispenser when the head is accessible.

The object of the present invention is to propose a fluid product dispenser that has a retractable head, is simple to manufacture and easy to handle for the user.

More particularly, the object of the present invention is a fluid product dispenser including: a tubular body extending along a main axis; a male element able to slide inside the tubular body; a volume for receiving the product inside the male element; said dispenser being characterized in that it moreover comprises a plate molding an external side surface of the tubular body, said plate being provided with at least one projection able to slide in a slit in the tubular body, substantially parallel to the main axis, said projection being able to move the male element in the tubular body, said dispenser comprising means for locking the plate onto the tubular body in at least two locking positions along the main axis.

According to a preferential embodiment of the invention, the dispenser comprises a product dispensing head, said head being connected to the male element, said head forming a projection from the tubular body when the plate is in a first locking position, said head being placed inside the tubular body when the plate is in a second locking position.

According to a preferential embodiment of the invention, the dispensing head comprises a dispensing orifice in a side wall of said head, said orifice being closed by an internal wall of the tubular body when the plate is in a second locking position.

According to a preferential embodiment of the invention, the tubular body comprises a bottom and an internal stop, limiting a stroke of the male element along the main axis.

According to an embodiment of the invention, the male element and the tubular body have a circular section so as to be able to pivot in one another. According to another embodiment of the invention, the male element and/or the tubular body can have a noncircular section, for example oval or polygonal.

According to a preferential embodiment of the invention, the projection on the plate is able to slide in a slit in a side wall of the male element, said slit being disposed obliquely with respect to the main axis, so that a displacement of the plate parallel to said axis, in cooperation with the bottom or the stop of the tubular body, is able to make the male element pivot about said axis in the tubular body.

According to a preferential embodiment of the invention, a rotational movement of the male element in the tubular body is limited angularly by a stop supported by the male element, cooperating with a stop supported by an internal wall of the body.

According to a preferential embodiment of the invention, the dispensing head comprises a pushbutton, connected to a fluid product dispensing member, said member enabling to extract some product contained in the receiving volume and to expel it through a dispensing orifice.

According to a preferential embodiment of the invention, the dispensing member is actuated by pressing the pushbutton along the main axis towards the bottom of the tubular body.

According to a preferential embodiment of the invention, the pushbutton is blocked in axial translation with respect to the male element when the plate is in a second locking position.

According to a preferential embodiment of the invention, means for locking the plate in the slit in the tubular body are put into position and/or removed because of the elasticity of the walls of the slit in the tubular body and/or the projection on the plate.

Figure 1B:
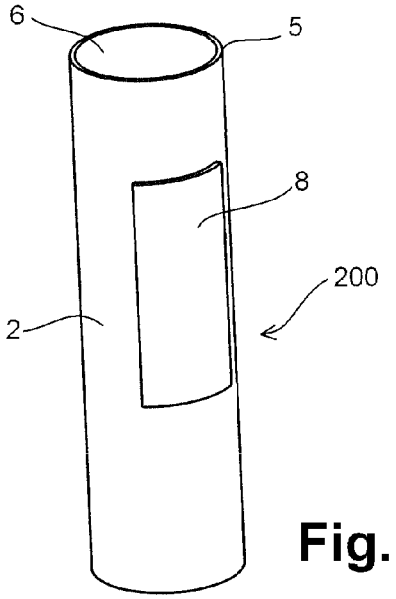
Figure 2:
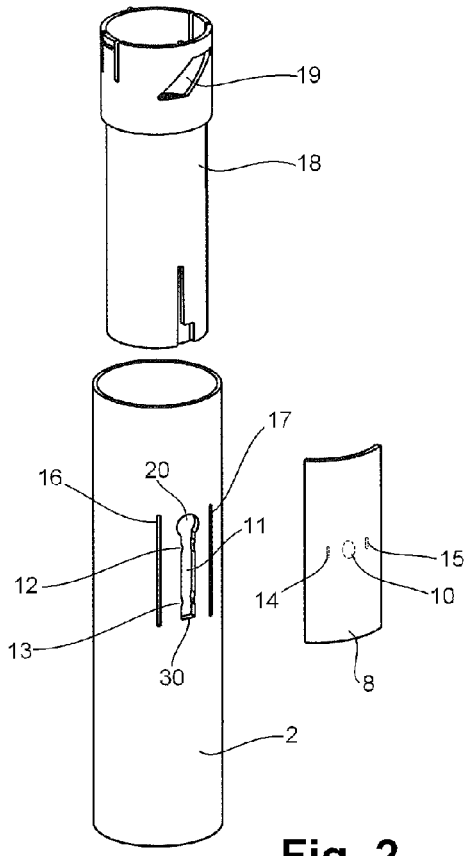

The invention will be better understood when reading the following description and examining the annexed Figures which are given as an indication, and by no means a restriction, of the invention. The Figures show:

FIGS. 1*a* and 1*b*: perspective views of a dispenser according to the same embodiment of the invention;

FIG. 2: a partially exploded view of the dispenser represented in FIGS. 1*a* and 1*b;*

Figure 3:
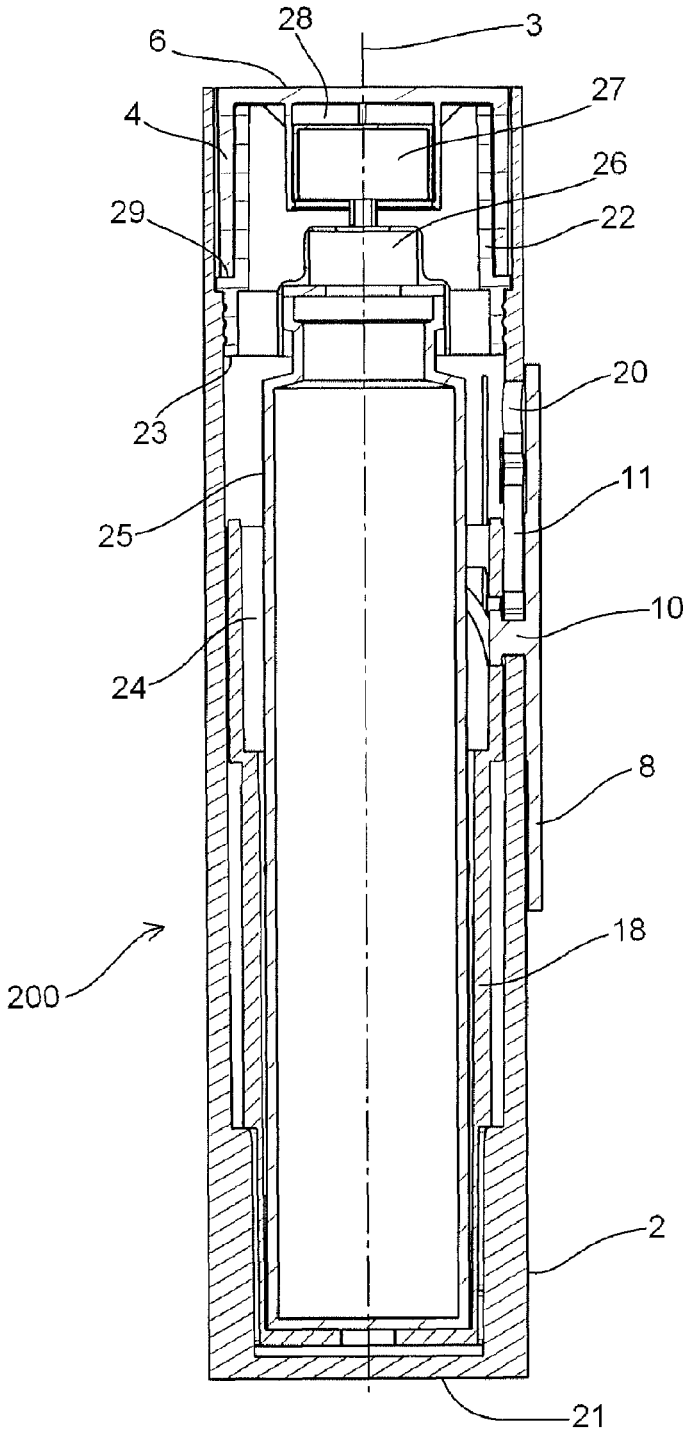

FIG. 3: a sectional view of the dispenser represented in FIG. 1*b;*

Figure 4:
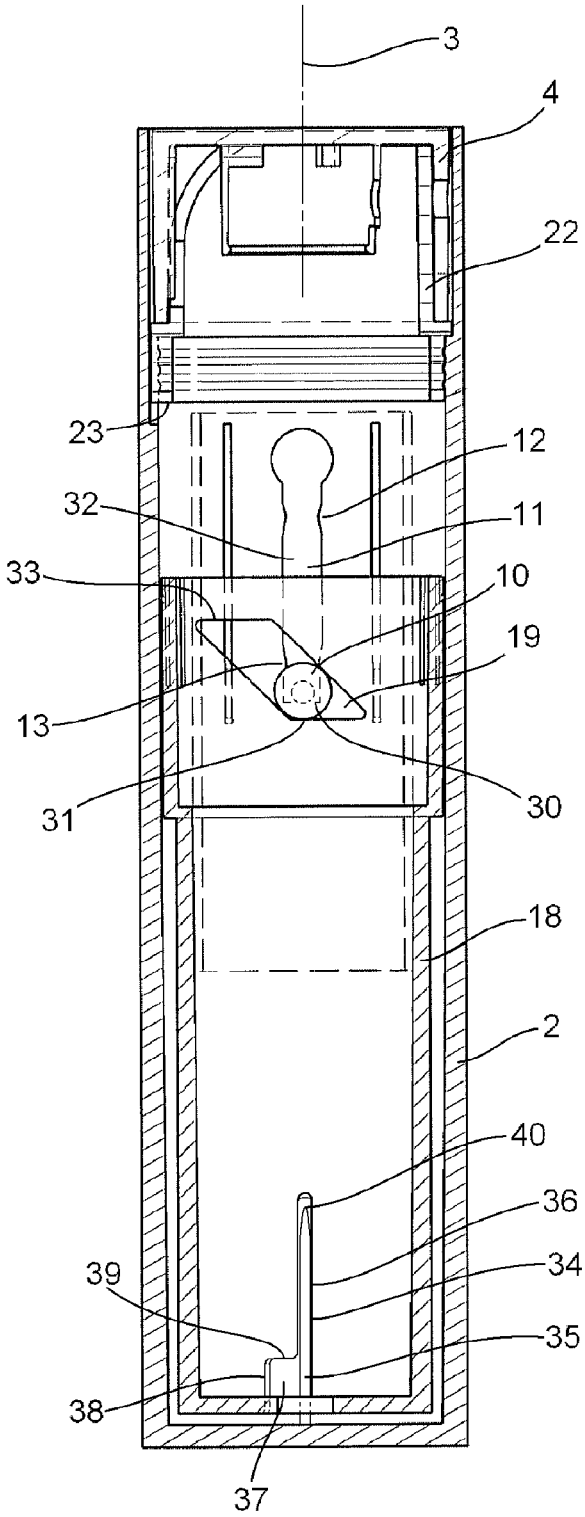

FIG. 4: a partial sectional view of the dispenser represented in FIG. 1*b*.

FIG. 1*a* represents a perspective view of a dispenser according to an embodiment of the invention. It is for example a liquid product dispenser, such as a toilet water, a perfume or a pharmaceutical or hygienic composition.

The dispenser 1 comprises a tubular body 2. The body 2 has the shape of a cylinder of revolution extending along an axis 3.

The dispenser 2 moreover comprises a head 4. In a position of use 100, as represented in FIG. 1*a*, said head 4 forms a projection along the axis 3 with respect to an end 5 of the body 2.

A transversal face 6 of the head 4 forms a pushbutton which allows, by an axial pressure, to actuate a dispensing member contained in the dispenser 1. This member is associated with a nozzle which enables to spray a liquid in fine droplets, through an orifice 7 in a side wall of the head 4.

The head 4 is retractable so as to protect the orifice 7 when carrying the dispenser 1. FIG. 1*b* shows the dispenser represented in FIG. 1*a*, the head 4 being in a storage position 200. In this position, the transversal face 6 and the end 5 of the body 2 are coplanar. The orifice 7 is then protected, in contact with an internal wall of the body 2.

The head 4 between the storage position 200 and the position of use 100 is moved thanks to a plate 8 which molds an external side surface 9 of the tubular body 2. The plate 8 can slide with respect to the surface 9 along an axis parallel to the axis 3. In order to put the head 4 in the position of use 100, as in FIG. 1*a*, a user moves the plate 8 towards the end 5 of the body 2. In order to put the head 4 in the storage position 200, as in FIG. 1*b*, the user moves the plate 8 in the opposite direction.

The dispenser 1 is provided with means for locking the plate 8 in at least two positions, corresponding to the storage position 200 and the position of use 100. These means will be detailed below.

FIG. 2 shows a partial exploded view of the dispenser 1 represented in FIGS. 1*a* and 1*b*. One can see the tubular body 2 and the plate 8. The plate 8, which molds a side surface of the body 2, has a slightly bent shape with a concave face oriented towards the body 2 and a convex face oriented towards the outside of the dispenser 1.

The concave face of the plate 8 supports at least one projection 10. Said projection can slide in a slit 11 in the surface 9 of the body 2. The slit 11 is substantially rectilinear, oriented parallel to the axis 3.

The slit 11 comprises at least two narrow portions (12, 13) in its width. A first narrow portion 12 is located near an end 20 of the slit 11, said end being oriented towards the head 4. A second narrow portion 13 is located near an opposite end 30 of the slit 11.

The narrow portions (12, 13) allow, via an elastic interlocking, to lock the projection 10 in at least two positions along the slit 11. Two of these positions correspond respectively to the position of use 100 (FIG. 1*a*) and the storage position 200 (FIG. 1*b*) of the head 4.

In the example represented in FIG. 2, the plate 8 comprises two additional projections (14, 15), located on both sides of the projection 10 with respect to its axis of sliding motion. The projections (14, 15) are able to slide in two slits (16, 17) in the body 2, simultaneously with the projection 10 in the slit 11. The projections (14, 15) and the slits (16, 17) enable to improve the guidance of the plate 8 along the body 2.

In FIG. 2, one can also see a male element 18, able to slide inside the tubular body 2. The male element 18 has substantially a cylindrical shape of revolution.

A side wall of the element 18 comprises a slit 19. Said slit has substantially the shape of a portion of a circular helix. More precisely, the slit 19 is disposed obliquely with respect to the axis 3. In a preferential way, a projection of the slit 19 in a plane containing the axis 3 forms with said axis an angle between 30° and 60°, more preferentially between 40° and 50°.

The projection 10 of the plate 8 is inserted in the slit 19. In this manner, the plate 8 can move the element 18 relative to the body 2. In particular, the plate 8 can move the element 18 in translation relative to the body 2 along the axis 3.

As it will be detailed below, the element 18 is connected to the head 4 which can be seen in FIG. 1*a*. The translation movement of the element 18 enables to place the head 4 into the storage position or the position of use.

FIG. 3 shows an axial sectional view of the previously described dispenser 1. One can see in particular the tubular body 2, the male element 18, the plate 8 and the head 4. Said head is in the storage position 200.

The projection 10 on the plate 8 is inserted into the slit 11 in the body 2. According to the cutting plane in FIG. 3, the projection 10 has a T-profile. More particularly, a part of the projection 10 forms a stop against an internal wall of the body 2, preventing the plate 8 from being separated from said body 2 because of a lateral traction. When assembling the plate 8 and the body 2, the projection 10 is introduced into the slit 11 through a widened end 20 of said slit.

The body 2 comprises a bottom 21 at its end opposite the head 4. In addition, a ring 22 is mounted to the body 2, for example by way of a thread, near the head 4. The ring 22 forms a stop 23 inside the body 2, in order to limit the stroke of the male element 18 along the axis 3.

The male element 18 comprises an internal volume 24 receiving a fluid reservoir 25 therein. The reservoir 25 is maintained fixed inside the element 18. An orifice in the reservoir 25 is provided with a fluid product dispensing member 26, for example an actuator 27 connected to a pump. Such a dispensing member is known in the state of the art.

The actuator 27 is embedded in a housing 28 in the head 4. Thus, the head 4 is connected to the male element 18 via the reservoir 25 and the dispensing member 26. The actuator 27 comprises a dispensing nozzle (not represented) which enables to expel some fluid through the orifice 7 (FIG. 1*a*) in the head 4.

When the head 4 is in the storage position 200, as in FIG. 3, a stop 29 formed by the ring 23 prevents the head 4 from moving in axial translation relative to the male element 18. When the head 4 is in the position of use 100 (FIG. 1*a*), there is a play between said head and the stop 29, along the axis 3. A pressure on the push rod 6 enables to insert the head 4 towards the element 18, which causes the member 26 to dispense a certain amount of fluid through the orifice 7.

FIG. 4 represents a partial sectional view of the dispenser 1. For a better comprehension, the reservoir 25 and the dispensing member 26 are not represented in FIG. 4. The cutting plane is axial and perpendicular to the cutting plane in FIG. 3.

In FIG. 4 on can see the body 2, the male element 18, the ring 22 and the head 4. Said head 4 is in the storage position, as in FIG. 3.

One can see the projection 10 on the plate 8, inserted in the slit 11 in the body 2. The projection 10 is maintained between the end 30 of the slit 11, oriented towards the bottom 21, and the second narrow portion 13 of the width of said slit 11. The plate 8 is thus locked relative to the body 2, so as to maintain the head 4 in the storage position.

In addition, the projection 10 is inserted into the helical slit 19 in the male element 18, disposed obliquely with respect to the axis 3. When the head 4 is in the storage position, the projection 10 is located near an end 31 of the slit 19. Said end 31 is oriented towards the bottom 21 of the body 2.

To put the head 4 into the position of use, a user has to move the plate 8 in translation parallel to the axis 3 so as to move the plate 8 away from the bottom 21.

Because of the present elasticity, the projection 10 passes through the narrow portion 13 and slides into a median part 32 of the slit 11.

When moving parallel to the axis 3, the projection 8 also moves the male element 18, which slides in the body 2 towards the ring 22. During this translation of the male element 18, the projection 10 remains substantially fixed in the slit 19.

The element 18 then comes into contact with the stop 23 formed by the ring 22. If the user continues to exert on the plate 8 a force parallel to the axis 3, a component of said force forces the element 18 to pivot against the ring 22. At the same time, the projection 10 moves in the slit 19 towards another end 33, oriented towards the head 4, of said slit.

Because of the elastic interlocking, the projection 10 then passes through the first narrow portion 12 of the slit 11.

In addition, the male element 18 comprises a notch 34 in which can slide a strip 35 supported by an internal side face of the body 2 near the bottom 21. The strip 35 extends parallel to the axis 3.

The notch 34 is substantially L-shaped. A part 36 of said notch extends parallel to the axis 3. A part 37, perpendicular to the part 36, extends along an end of the element 18 oriented towards the bottom 21 of the body 2.

When the head 4 is in the storage position, the strip 35 is inserted in the part 36 of the notch 34. When the plate 8 is moved to put the head 4 into the position of use, the strip 35 slides in the part 36, then moves into the part 37 when the element 18 pivots relative to the ring 22.

The rotation of the element 18 is limited by a stop 38, formed by an end of the part 37 of the notch. In the example represented in FIG. 4, a dimension of the part 37 perpendicular to the axis 3 is such that the male element 18 can pivot in the body 2 by an angle between 15° and 20° about the axis 3.

The stop 38 and the first narrow portion 12 of the slit 11 form the means for locking the plate 8 in the position of use of the head 4.

In addition, a stop 39 is formed by an edge of the part 37, said edge being orthogonal to the axis 3. When the user presses on the pushbutton 6, the interaction between the stop 39 and one end 40 of the strip 35 prevents the element 18 from being moved towards the bottom 21 of the body 2. The force exerted by the user on the head 4 thus leads to the actuation of the fluid dispensing member 26.

Pivoting the element 18 thus enables to block the axial displacement of said element 18 when the head 4 is in the position of use.

In order to put the head 4 back into the storage position, the user exerts on the plate 8 a force parallel to the axis 3, towards the bottom 21. While the projection 10 moves in the slit 19 in the male element 18, said element 18 pivots relative to the body 2, according to a movement opposite the pivoting movement described above. The projection 10 then moves the element 18 in translation towards the bottom 21, then reaches its locking position after passing through the second narrow portion 13.

The sliding movement of the plate 8 relative to the body 2, as well as the insertion of the plate 8 in either of the locking positions, are easily performed by the user. In particular, the plate 8 can be actuated by the thumb of a hand whose other fingers hold the body 2. The head 4 can thus be put with only one hand into the storage position 200 or position of use 100.

The invention claimed is:

1. A fluid product dispenser (1) including:

a tubular body (2) extending along a main axis (3);

a male element (18), able to slide inside the tubular body;

a product dispensing head (4), said head being connected to the male element;

a volume (24) for receiving the product, located inside the male element;

a plate (8) molding an external side surface (9) of the tubular body, said plate being provided with at least one projection (10) able to slide in a slit (11) in the tubular body, substantially parallel to the main axis, said projection being able to move the male element in the tubular body, said dispenser comprising means (30, 13; 12, 38) for locking the plate to the tubular body in at least two locking positions (100, 200) along the main axis, the dispensing head forming a projection with respect to the tubular body when the plate is in a first locking position (100), said head being placed inside the tubular body when the plate is in a second locking position (200), the tubular body comprising a bottom (21) and an internal stop (23), limiting a stroke of the male element along the main axis, the projection of the plate being able to slide in a slit (19) in a side wall of the male element, said slit being disposed obliquely with respect to the main axis, so that a displacement of the plate (8) parallel to said axis, in cooperation with the bottom or the stop of the tubular body, is able to make the male element pivot about said axis in the tubular body.

2. The dispenser according to claim 1, whose dispensing head comprises an dispensing orifice (7) in a side wall of said head, said orifice being closed by an internal wall of the tubular body when the plate is in a second locking position (200).

3. The dispenser according to claim 2, wherein a rotational movement of the male element in the tubular body is limited angularly by a stop (38) supported by the male element, cooperating with a stop (35) supported by an internal wall of the body.

4. The dispenser according to claim 3, wherein the dispensing head comprises a pushbutton (6), connected to a fluid product dispensing member (26), said member enabling to extract some product contained in the receiving volume (24) and to expel it through a dispensing orifice (7).

5. The dispenser according to claim 3, wherein the means (12, 13) for locking the plate are put into position and/or removed because of the elasticity of the walls of the slit (11) and/or the projection (10).

6. The dispenser according to claim 2, wherein the dispensing head comprises a pushbutton (6), connected to a fluid product dispensing member (26), said member enabled to extract some product contained in the receiving volume (24) and to expel it through a dispensing orifice (7).

7. The dispenser according to claim 2, wherein the means (12, 13) for locking the plate are put into position and/or removed because of the elasticity of the walls of the slit (11) and/or the projection (10).

8. The dispenser according to claim 1, wherein a rotational movement of the male element in the tubular body is limited angularly by a stop (38) supported by the male element, cooperating with a stop (35) supported by an internal wall of the body.

9. The dispenser according to claim 8, wherein the dispensing head comprises a pushbutton (6), connected to a fluid product dispensing member (26), said member enabled to extract some product contained in the receiving volume (24) and to expel it through a dispensing orifice (7).

10. The dispenser according to claim 8, wherein the means (12, 13) for locking the plate are put into position and/or removed because of the elasticity of the walls of the slit (11) and/or the projection (10).

11. The dispenser according to claim 1, wherein the dispensing head comprises a pushbutton (6), connected to a fluid product dispensing member (26), said member enabled to extract some product contained in the receiving volume (24) and to expel it through a dispensing orifice (7).

12. The dispenser according to claim 11, wherein the member (26) is actuated by pressing the pushbutton along the main axis (3) towards the bottom (21) of the tubular body.

13. The dispenser according to claim 12, wherein the push-button (6) is blocked (29) in axial translation with respect to the male element when the plate is in a second locking position (200).

14. The dispenser according to claim 13, wherein the means (12, 13) for locking the plate are put into position and/or removed because of the elasticity of the walls of the slit (11) and/or the projection (10).

15. The dispenser according to claim 12, wherein the means (12, 13) for locking the plate are put into position and/or removed because of the elasticity of the walls of the slit (11) and/or the projection (10).

16. The dispenser according to claim 1, wherein the means (12, 13) for locking the plate are put into position and/or removed because of the elasticity of the walls of the slit (11) and/or the projection (10).

17. The dispenser according to claim 11, wherein the means (12, 13) for locking the plate are put into position and/or removed because of the elasticity of the walls of the slit (11) and/or the projection (10).

* * * * *

UNITED STATES PATENT AND TRADEMARK OFFICE

CERTIFICATE OF CORRECTION

PATENT NO. : 8,714,412 B2
APPLICATION NO. : 13/642662
DATED : May 6, 2014
INVENTOR(S) : Benigni et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 12 days.

Signed and Sealed this
Twenty-ninth Day of September, 2015

Michelle K. Lee

Michelle K. Lee
*Director of the United States Patent and Trademark Office*